US005621921A

United States Patent [19]

Outland

[11] Patent Number: 5,621,921

[45] Date of Patent: Apr. 22, 1997

[54] HAT/COLLAR

[76] Inventor: Claudette Outland, Bleibtreustrasse #4, 10623 Berlin, Germany

[21] Appl. No.: 441,093

[22] Filed: May 15, 1995

[30] Foreign Application Priority Data

Jul. 22, 1994 [DE] Germany ..... 9412183 U

[51] Int. Cl.[6] ..... A42C 5/02

[52] U.S. Cl. ..... 2/207; 2/171; 2/DIG. 11

[58] Field of Search ..... 2/171, 171.03, 2/171.04, 207, 209.11, 209.3, 209.4, 209.7, DIG. 11; 132/273

[56] References Cited

U.S. PATENT DOCUMENTS 2,806,222 9/1957 Carpenter ..... 2/207

5,233,704 8/1993 Booher ..... 2/207

*Primary Examiner*—Diana Biefeld

*Attorney, Agent, or Firm*—Dann, Dorfman, Herrell And Skillman; John C. Dorfman

[57] ABSTRACT

A hat or collar uses a tubular sleeve of an oval annular configuration. The sleeve is composed of a flexible fabric having sufficient body and firmness to retain full malleable wire capable of being deformed by hand and is placed within the sleeve. The wire is of such length and general configuration as to fit within, conform to and generally define an outer periphery of the annular configuration of the sleeve throughout most of the length of that periphery. It preferably is stitched in position so that it can slip somewhat relative to the fabric as the malleable wire is deformed by hand. Forming the wire by hand changes the shape and appearance of the hat such that it retains such changed shape until again deformed by hand. The elastic connector attached to each of the respective ends of the tubular sleeve elastically interconnects those ends so that sufficient stretch is provided that the inner periphery of the annulus can serve as a hat band adjusting to the wearer's head size. Preferably the elastic member is covered by a fabric of the type used for the sleeve and possibly attached to the sleeve. It is provided with convoluted folds to accommodate the stretching of the elastic connector. When used as a collar, the inner periphery is slipped down over the head of the wearer where it will normally be loose around the wearer's neck and can be repositioned as desired for use as a collar.

7 Claims, 3 Drawing Sheets

HAT/COLLAR

The present invention relates to a hat which may also be used as a collar or neck gaiter around the neck. In addition to being sufficiently versatile to be worn either around the neck or around the head, the hat/collar of the present invention has the virtue of being capable of being shaped into many forms.

BACKGROUND OF THE INVENTION

The prior art has examples of reversible clothing, including hats, whereby different colors may be displayed by simply reversing the structure or turning it inside out. Some hats, by the nature of their fabric, such as felt, are capable of a certain amount of shaping, but usually once shaped the hat does not lend itself to reshaping without considerable effort. Many hats have been made of soft fabric so that depending on how the hat is worn, the fabric may fall differently and to give somewhat different appearances. The present invention, however, is directed to a hat which is capable of being reshaped and worn in different modes in various shaped forms. The structure of such a hat is believed by the inventor to be novel.

The hat of the present invention is basically an annular structure. Although a cap conforming to the top of the head might be attached to the inner edge of the annulus, for most purposes such a structure is not desired. In fact, without the added cap, the inner edge instead of fitting against the head of a wearer may be lowered to neck level and provides a decorative collar. In either form, the annulus is comprised of a tubular collar of flexible material with sufficient body to aid in the maintaining of selected shapes and preferably to resist wrinkles. Within the tubular body is provided a malleable wire having a minimum elasticity and capable of being deformed to change shape. Once deformed, it retains the changed shape until further deformation which preferably can be done easily by the hands of the wearer. The malleable wire is of such length and general configuration as to fit within, conform to and generally define an outer periphery of the generally oval configuration of the sleeve throughout most of the length of that periphery. The wire is preferably stitched adjacent the outer edge of the annular sleeve so that it will be held along that periphery, but preferably in a way such that the wire can slip within the stitching as deformation occurs. The ends of the sleeve are connected together by an elastic connector attached to each of the respective ends of the tubular sleeve, as by sewing, to complete the annulus. This is done in such a way that an elastic stretch provided by the connector and the relatively unstretchable inner periphery of the annulus will serve together as a hat band adjusting to the wearer's head size. In most cases it is preferred to cover the elastic connector by a small tube of the same material as the hat which may also be stitched between the ends of the tubular sleeve or actually made as a reduced end portion of one end of the tubular sleeve and stitched to the other. In either event, the tubular connector member is folded or convoluted like a bellows in order to accommodate the elastic connector in its relaxed position, but allow it to be stretched unfolding the convolutions to accommodate the head of the wearer and serve to adjust the size of the hat band as needed.

When used as a hat, the inner periphery provides stability on the head of the wearer and the outer periphery is given form by the malleable wire within the tubular member at its outer edge. The outer periphery is preferably smaller than would be necessary to allow the tube to lie flat so that the wire will tend to hold it above the headband or below the headband depending upon how it is adjusted by the wearer. From either of these positions it may be moved in various ways to achieve different tilted or folded effects using the natural foldability of the fabric and bendability of the wire. The hat is intended to be shaped by bending the malleable wire to any desired shape to give interesting folds and contours to the hat.

When used as a collar even more versatility is possible. The collar can be used in different ways by providing the narrow elastic connected portion in the back of the neck of the wearer or in the front. It can be turned down or up to give a different effect in either position and again it can be made to assume different kinds of patterns by bending the malleable wire and patterning the fabric as desired.

More specifically, the hat/collar of the present invention comprises a tubular sleeve of generally annular configuration, said sleeve being composed of flexible fabric having sufficient body and firmness to retain folds. A malleable wire having minimum elasticity and capable of being deformed by hand to change its shape. The malleable wire retains such changed shape until again deformed by hand. The malleable wire is of such length and general configuration as to fit within and conform to and generally define an outer periphery of the annular configuration of the sleeve throughout most of the length of that periphery. An elastic connector is attached to each of the respective ends of the tubular sleeve to elastically interconnect the ends to complete the annulus in such a way that the elastic stretch is provided and the inner periphery of the annulus will serve as a hat band adjusting to the wearer's head size.

THE DRAWINGS

THE SPECIFIC EMBODIMENT OF THE INVENTION

Figure 1:
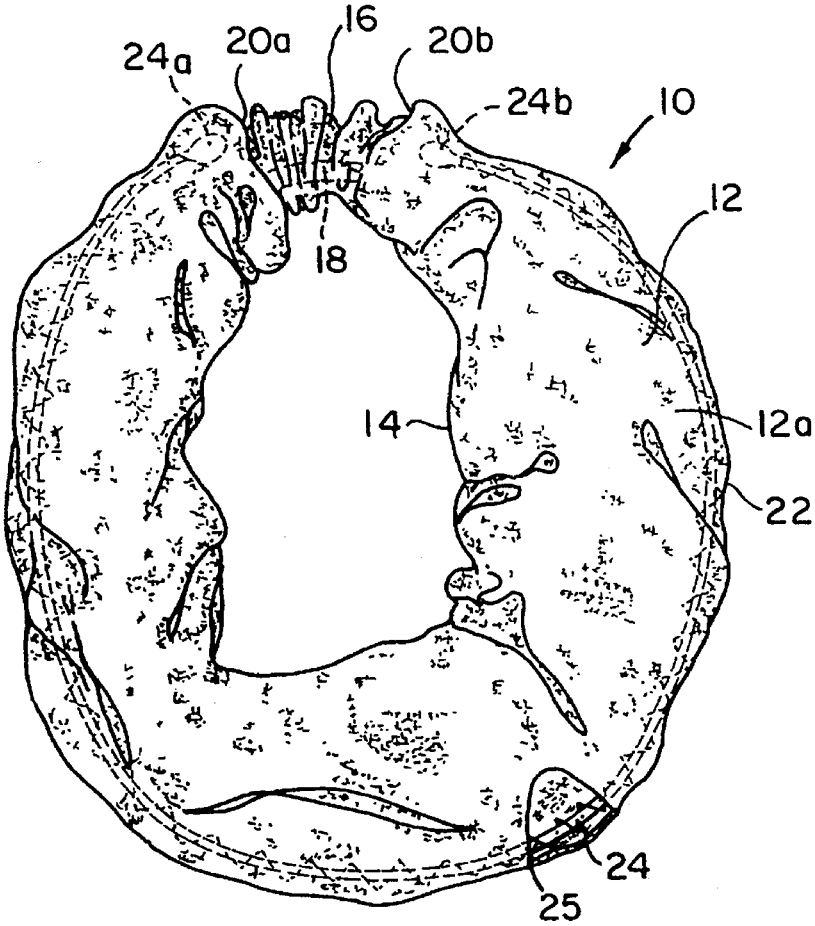
FIG. 1 is a plan view of the hat/collar of the present invention.
Figure 2:
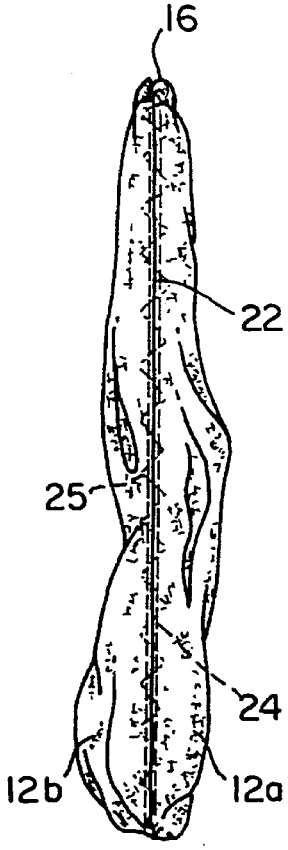
FIG. 2 is a side elevation of the same structure.
Figure 3:
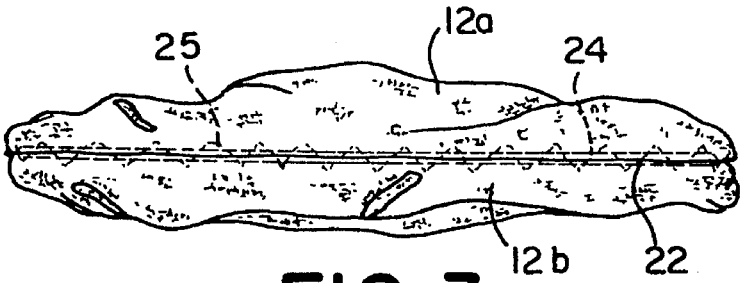
FIG. 3 is a front elevation of the same structure.

FIGS. 1–3 are intended to show the structure of the hat/collar which may be used as a hat or a collar (also known as a gaiter) in accordance with the present invention. FIGS. 4–7 show four variations of many forms as a hat of FIGS. 1–3 may assume on a wearer. FIGS. 8–11 show four additional variations of the hat/collar used as a collar or a neck gaiter. It will be understood that the examples of use shown in FIGS. 4–11 are but 8 of an infinite variety of ways the hat/collar may be worn.

Referring to FIGS. 1–3, it will be seen that the hat/collar consists of an essentially annular structure, generally designated 10, as best seen in FIG. 1. The hat/collar consists of a tubular fabric structure 12 which conceivably could be made of a single piece of fabric, but most commonly and preferably will be made of two pieces of fabric providing a top 12*a* and bottom 12*b*. More than two pieces can be used and the pieces need not extend around the entire circumference, but together need to provide the tubular structure. The material selected for the hat/collar preferably is entirely, or has in major part, of sufficient body to be somewhat self-supporting, as opposed to being limp. For example, velvet is a preferred material because of its body as well as its dressy attractiveness. Leather may be appropriate in certain instances, as may be fur. The hat may as well be trimmed with fur pieces or other ornamentation, which is subject to many variations in the discretion of the wearer or the manufacturer.

In order to complete the inner edge which serves as a hatband, which may be sized to the wearer as with any hat, the ends of the tabular piece need to be connected together. The inner edge may be preferably designed to stretch somewhat and to that end, an elastic member 18 is connected between the ends of the tubular sleeve 22. The elastic member 18 (shown in phantom) within a smaller diameter tubular cover portion 16 is corrugated somewhat in annular folds to allow for some stretch of the elastic member 18. Cover 16 may be made of the same fabric as the rest of the hat. If the corrugated tubular portion 16 has its ends attached to the ends 20*a* and 20*b*, respectively, by stitching, the same stitching or additional stitching may be used to attach the elastic member 18. The cover 16 may alternatively be an extension at one end of the tubular fabric structure and sewn to the other end.

In the embodiment shown the top and bottom portions 12*a* and 12*b* are made of two separate similar pieces of the same kind of material stitched together at the inside edge 14 and at an outside edge 22 all the way around the periphery. In FIGS. 2 and 3 the seam stitching together pieces 12*a* and 12*b* at the outside periphery may be considered to be the outside periphery, although in other embodiments this may not necessarily be so. Similarly the inside seam may lie along the headband or the inner periphery 14. Such stitching conventionally is made with the pieces placed inside out and, after the stitching is done, the pieces are turned outside out. At this point within the tubular structure 12 a suitable malleable bendable wire without appreciable resilience or plastic memory is inserted, as seen best in FIG. 1 as the dashed line structure labeled 24. Stitching 25 (shown in phantom) is also preferably used to hold the wire in place so that it can be more relative to the stitching. Alternatively, a tubular hem along the outer edge of one piece 12*a* or 12*b* may be formed before the pieces are sewn together and can be used to receive the wire 24. A generally oval configuration conforms generally to the outer periphery of the sleeve 12 with the separated ends 24*a* and 24*b* of the wire 24 terminating just short of the ends 20*a* and 20*b* of the tubular sleeve 12. The ends of the wire may be flattened, rounded and bent slightly outwardly to prevent penetration of fabric and to avoid the possibility that in any position where the wire approaches the head of the wearer it might tend to dig into the head. In FIG. 1 a small portion of the fabric 12*a* is shown cut away to expose the wire. It will be understood that this is merely done in the drawings for purposes of showing with clarity the internal structure to aid in understanding the invention. In the ordinary course such cutting is not done in actual hat/collars, although the possibility that some special effect might be desired by doing something of this sort is not precluded. Once the wire 24 is in place, the corrugated piece 16 and the elastic member within it may be put in place and stitched separately or together to the ends 20*a* and 20*b* of the tubular body 12 of the hat/collar. Often one end of the tubular corrugated member at the outer edge is not attached and a smaller tubular extension portion at the end 24*a* is extended within tubular piece 16. An extension separately attached to the end 20*a* to extend that end may be corrugated as tube 16 so that it appears to be one continuous piece of material. It will be understood that the corrugated tube 16 is preferably of the same material as that of the pieces 12*a* and 12*b* and may indeed be an extension at one end to the other.

It will be seen in FIG. 1 that the pieces 12*a* and 12*b* are not uniform in width around their periphery. Normally the corrugated piece 16 will go in the back of the hat/collar and the front or part opposite the corrugated piece 16 is the widest portion of the tubular portion 12 with the ends 20*a* and 20*b* tapering down to the narrowest portions. Also, the outer periphery is preferably of such length that when connected the wire supported periphery will lie above or below the plane of the headband.

Figure 4:
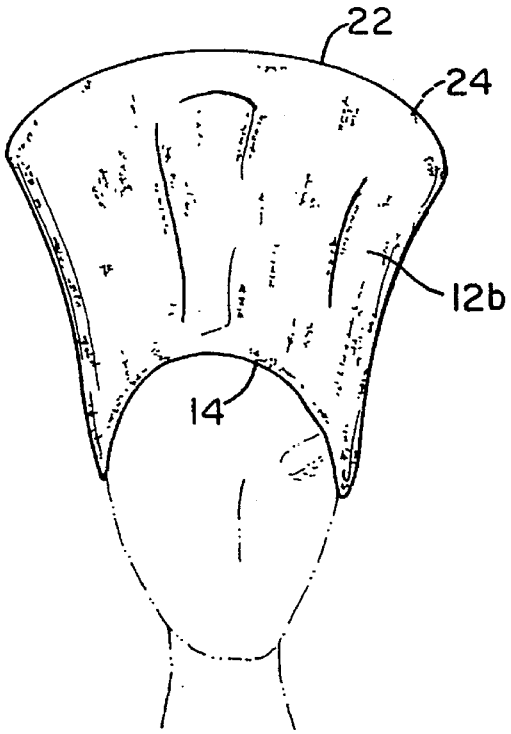
FIGS. 4–7 are perspective views of the hat/collar used as a hat on the head of a wearer or a mannequin illustrating some of the various possibilities for use of the hat/collar.
Figure 5:
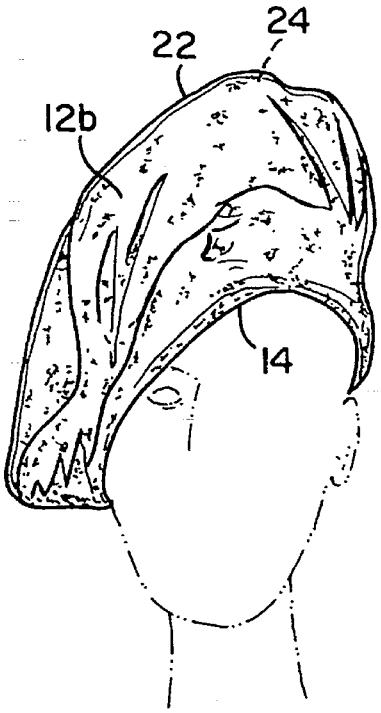

Referring now to FIGS. 4–7, it will be seen that when the headband or inner periphery 14 is snugly fitted on the head of a wearer a relatively stable support structure is provided. Since the fabric is flexible but has body it is possible to stretch the fabric to its full extension above the head of the wearer and provide a rather smooth somewhat frustoconical surface between the inner and the outer periphery with the outer periphery being supported by the wire 24. By bending the wire slightly in one or more places as shown in FIG. 5 and forming or draping the fabric somewhat, a more casual folded appearance is achieved.

Figure 6:
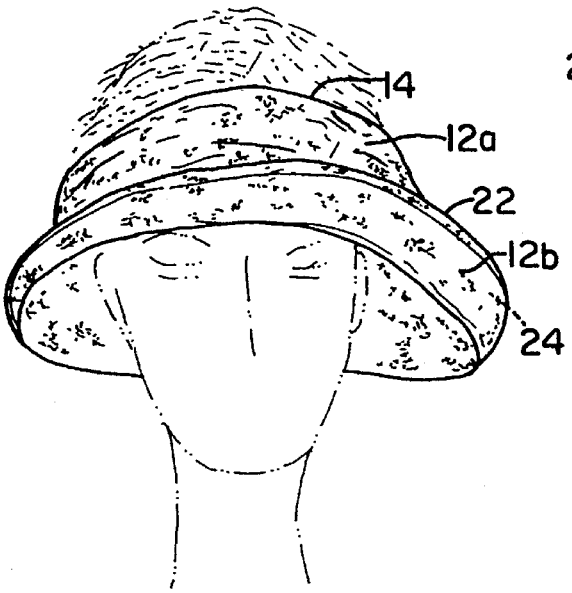

FIG. 6 shows a version in which the top side 12*a* is seen as a brim or rim below the headband. This adjustment is formed again keeping the wire in a more or less circular form as in FIG. 4.

Figure 7:
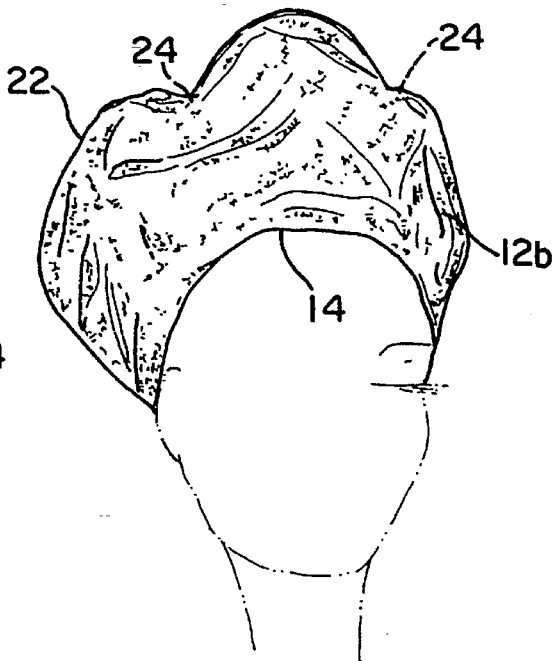

FIG. 7 shows a variation in which the hat is worn much like FIG. 4, but the wire is bent in multiple places and inward instead of downward as in FIG. 5. Any number of variations and combinations are possible, which is part of the fascination with the hat of the present invention.

Figure 8:
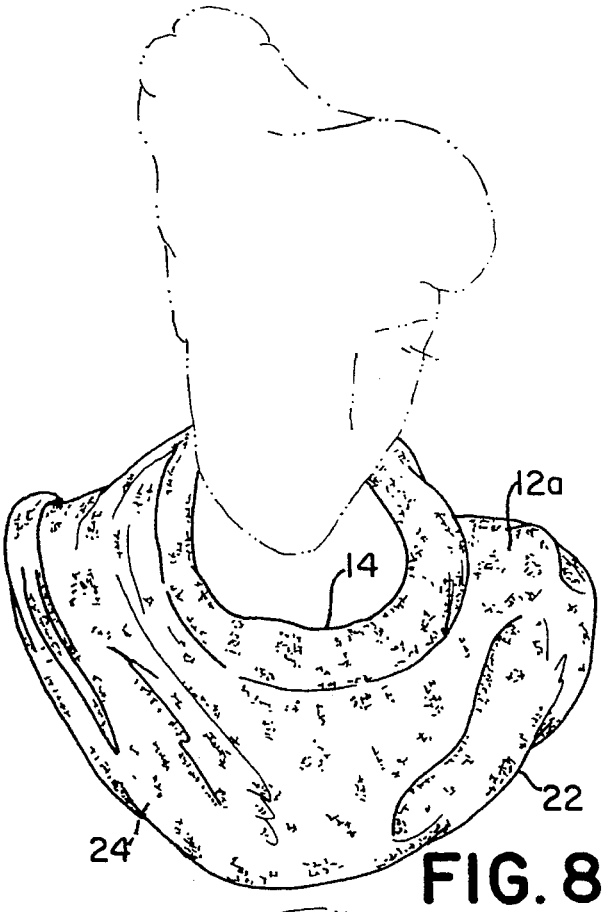
FIGS. 8–11 are perspective views of the hat/collar used as a collar on the neck of a wearer or a mannequin illustrating some additional possibilities for use of the hat/collar.

FIG. 8 shows the use of the hat/collar as a collar pulled over the head of a wearer.

Figure 9:
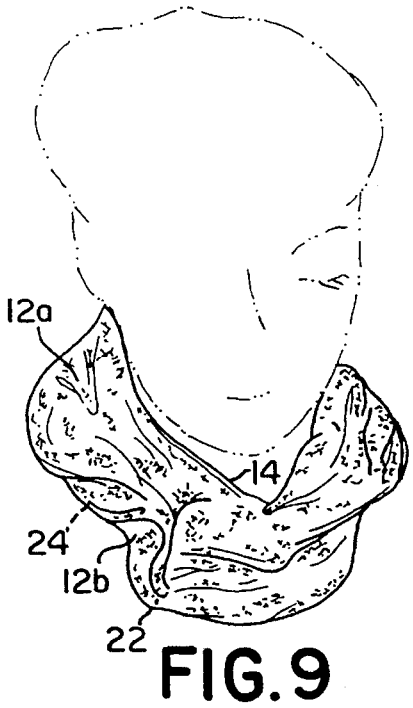

FIG. 9 shows the collar folded up along one edge from the position of FIG. 8.

Figure 10:
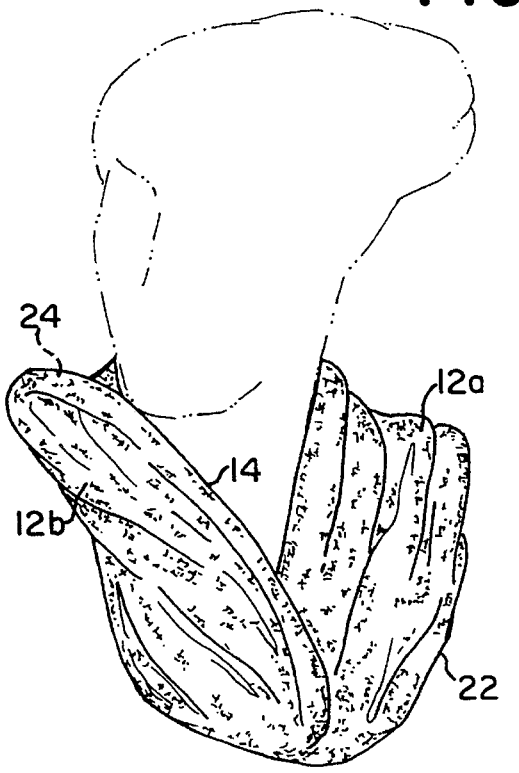

FIG. 10 shows the collar with the wire of the outer edges bent to produce multiple folds as selected by the user.

Figure 11:
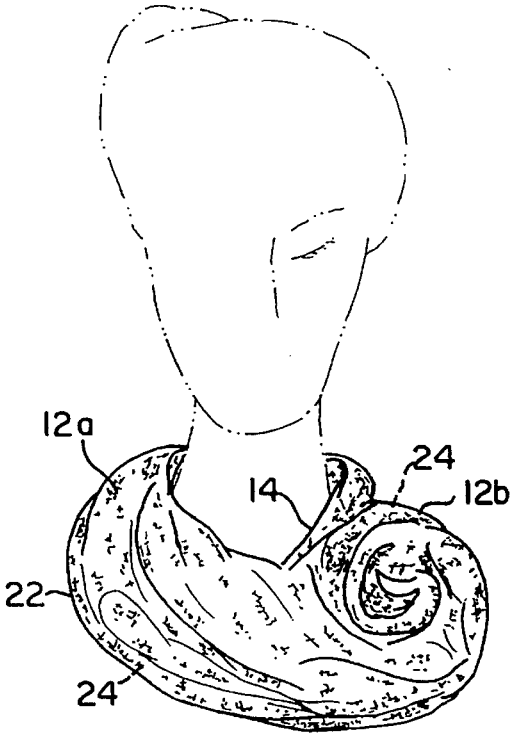

FIG. 11 shows the collar with the wire rolled to a curl in one place to produce a special effect at one point along an otherwise relatively smooth collar surface.

Variations and modifications of the present invention with the scope of the claims is possible. All such variations within the scope of the claims, or interpreted to be within the scope, are intended to be within the scope and spirit of the present invention.

I claim:

1. A hat/collar comprising:

an elongated tubular sleeve having sufficient body and firmness to retain folds;

an elastic connector attached between opposite ends of the elongated tubular sleeve to elastically interconnect the ends to complete an annulus in such a way that an elastic stretch is provided and so that an inner periphery of the annulus may serve as a hat band, adjusting to a wearer's head size a malleable wire within the sleeve having minimum elasticity and capable of being deformed by hand to change its shape and retaining such changed shape until again deformed by hand and of such length and general configuration as to conform to and generally define an outer periphery of the sleeve in the annular configuration throughout most of the length of the sleeve.

2. The hat/collar of claim 1 in which the malleable wire is stitched in place so as to be held along the outer periphery of the sleeve while allowing relative movement of the sleeve as the wire is deformed.

3. The hat/collar of claim 2 in which the outer periphery is not sufficiently large to be able to be in the same plane as the inner periphery when the annulus is completed.

4. The hat/collar of claim 1 in which the tubular sleeve is composed of pieces of fabric sewn together, respectively, generally along the inner and outer peripheries.

5. The hat/collar of claim 4 in which the pieces are of different material.

6. The hat/collar of claim 1 in which pieces of different material are used to piece together the tabular sleeve.

7. The hat/collar of claim 1 in which the elastic connector is enclosed in a flexible tube having corrugated annular folds along its length to accommodate expansion of the elastic connector and both the elastic connector and the enclosing tube are attached to opposite ends of the elongated sleeve to complete the annulus.

* * * * *